US010566749B2

(12) United States Patent
Tsau

(10) Patent No.: US 10,566,749 B2
(45) Date of Patent: Feb. 18, 2020

(54) CONNECTOR

(71) Applicant: EZCONN CORPORATION, Taipei (TW)

(72) Inventor: Chang-Jie Tsau, Taipei (TW)

(73) Assignee: EZconn Corporation, Taipei (TW)

( * ) Notice: Subject to any disclaimer, the term of this patent is extended or adjusted under 35 U.S.C. 154(b) by 0 days.

(21) Appl. No.: 16/186,617

(22) Filed: Nov. 12, 2018

(65) Prior Publication Data

US 2019/0148895 A1 May 16, 2019

(30) Foreign Application Priority Data

Nov. 13, 2017 (TW) ..... 106216885 A

(51) Int. Cl.

| | |
|---|---|
| ***H01R 24/52*** | (2011.01) |
| ***H01R 13/622*** | (2006.01) |
| ***H01R 13/516*** | (2006.01) |
| ***H01R 13/426*** | (2006.01) |
| ***H01R 13/424*** | (2006.01) |
| ***H01R 103/00*** | (2006.01) |
| ***H01R 12/72*** | (2011.01) |

(52) U.S. Cl.

CPC ..... *H01R 24/52* (2013.01); *H01R 13/424* (2013.01); *H01R 13/426* (2013.01); *H01R 13/516* (2013.01); *H01R 13/622* (2013.01); *H01R 12/724* (2013.01); *H01R 2103/00* (2013.01)

(58) Field of Classification Search

CPC .... H01R 24/52; H01R 13/424; H01R 13/426; H01R 13/516; H01R 13/622; H01R 12/724

See application file for complete search history.

(56) References Cited

U.S. PATENT DOCUMENTS

| | | | | | |
|---|---|---|---|---|---|
| 2,552,686 | A * | 5/1951 | Melcher | H01R 24/52 | 174/153 R |
| 4,368,940 | A * | 1/1983 | Sugiura | H01R 24/52 | 439/170 |
| 4,713,024 | A * | 12/1987 | Hatakeyama | H01R 24/547 | 439/551 |
| 5,108,300 | A * | 4/1992 | Weber | H01R 13/7033 | 439/188 |
| 5,186,633 | A * | 2/1993 | Mosser, III | H01R 12/57 | 439/79 |

(Continued)

*Primary Examiner* — Oscar C Jimenez

(57) ABSTRACT

A connector comprising a connector body, a first dielectric component, a conductor component, a second dielectric component and an inner sleeve is provided. The connector body has a radial front side surface having a plurality of attachment protrusions extended thereon. The first dielectric component has a protruding end portion comprising a first outlet. The conductor component has a conductor body and a conductor strip end, whereby the conductor strip end extends from the conductor body. The first dielectric component is fixed within the connector body, the second dielectric component is fixed within the inner sleeve, and the inner sleeve is fixed within the connector body. The conductor body is fixed within the second dielectric component, inner sleeve, connector body, and first dielectric component, whereby the conductor strip end extends outwardly from the first outlet, and the conductor strip end is fixedly moveable within the first outlet.

16 Claims, 7 Drawing Sheets

(56) References Cited

U.S. PATENT DOCUMENTS

| | | | | |
|---|---|---|---|---|
| 7,909,614 | B1 * | 3/2011 | Chang | H01R 13/41 439/581 |
| 9,871,315 | B1 * | 1/2018 | Huang | H01R 13/426 |
| 2004/0014334 | A1 * | 1/2004 | Lu | H01R 9/0506 439/63 |
| 2005/0037664 | A1 * | 2/2005 | Weidner | H01R 9/05 439/581 |
| 2005/0077981 | A1 * | 4/2005 | Tsao | H01R 9/0506 333/182 |
| 2010/0022123 | A1 * | 1/2010 | Zhang | H01R 13/42 439/578 |
| 2011/0165789 | A1 * | 7/2011 | Sykes | H01R 13/6277 439/352 |
| 2015/0222061 | A1 * | 8/2015 | Kaneko | H01R 24/44 439/581 |
| 2017/0317453 | A1 * | 11/2017 | Tsau | H01R 24/38 |

* cited by examiner

CONNECTOR

RELATED APPLICATIONS

The present application claims priority to Taiwan application no. 106216885, filed on Nov. 13, 2017, of which is hereby incorporated by reference in its entirety.

BACKGROUND OF THE INVENTION

Field of the Invention

The invention relates to connectors.

Description of the Related Art

Coaxial cables continue to be used using connectors such as twistable F-type connectors. The F-type connectors are used for connection with cable TV decoders, digital video recorders and DVD recorders, satellite receivers and distribution amplifiers or signal splitters, etc., having a mounting means built therein.

Conventional connectors are mounted to an electromagnetic interference (EMI) shielded enclosure or housing of the corresponding decoders, recorders, receivers, amplifiers or splitters etc. or have a mounting means therewith. After mounting, a conductor of the conventional connectors is soldered to a contact pad on the surface of a printed circuit board for operation.

Most conventional connectors are manufactured or assembled using semi- or fully-automatic machines, such as cutting, stripping and crimping, riveting and wire welding machines. Despite, as the manufacturing or assembly process and/or age of a machine increase, sufficient accuracy to maintain connector reliability decreases. For example, if the conductor of the conventional connectors is too long or too short (e.g. >±2 cm), either by length or formation, soldering to the contact pad on the surface of the printed circuit board will be hindered, decreasing connector reliability, or worse, not be available. While required length tolerances and quality control can be implemented with manual labor, human error and maintaining consistent precision can be time consuming and inefficient.

There is demand for connectors to solve the aforementioned problems.

BRIEF SUMMARY OF THE INVENTION

Connectors are provided.

In an embodiment, the connector comprises a connector body, a first dielectric component, and a conductor component. The connector body has a radially protruding outer end portion, a threaded outer surface and a through-hole therethrough having a central axis. The radially protruding outer end portion radially protrudes outwardly at a first body opening end of the connector body and is disposed next to the threaded outer surface. The first dielectric component has a protruding end portion, a first tube body and a cylindrical center tube therethrough. In an embodiment, the protruding end portion comprises a first outlet. In an embodiment, the first outlet, protruding end portion, first tube body and cylindrical center tube have a central axis. The conductor component has a conductor body comprising a first conductor body end and a second conductor body end and a conductor through-hole therethrough having a central axis and a conductor strip end, whereby the conductor strip end extends from the first conductor body end of the conductor body. In an embodiment, the conductor component can be electrically connected to a coaxial cable having an electrical wire, sending electrical signals. In an embodiment, the shape of the conductor strip end of the conductor component is flat-shaped.

In an embodiment, the first dielectric component is engaged and fixed within the through-hole of the connector body through the first body opening end, whereby the protruding end portion protrudes outwardly from the first body opening end of the connector body. In an embodiment, the conductor component is engaged and fixed within the through-hole of the connector body through a second body opening end of the connector body opposite the first body opening end and within the cylindrical center tube of the first dielectric component, whereby the conductor strip end extends outwardly from the first outlet of the dielectric component, and the conductor strip end is fixedly moveable within the first outlet. In an embodiment, the central axis of the connector body and first dielectric component are the same.

In an alternative embodiment, the connector body further comprises a radially protruding inner end portion having an inner locking wall and a plurality of guide protrusions thereon having a plurality of blocking guide walls, respectively. The radially protruding inner end portion radially protrudes inwardly at the first body opening end of the connector body and is disposed opposite the radially protruding outer end portion. The inner locking wall is opposite the first body opening end and the plurality of blocking guide walls are opposite the second body opening end. In an embodiment, the shape of the radially protruding inner end portion is ring-shaped. In an embodiment, the shape of the plurality of guide protrusions is arc-shaped. In an embodiment, the number of the plurality of guide protrusions is at least two. In an embodiment, each of the plurality of guide protrusions further comprises two opposite side walls perpendicular to the inner locking wall, wherein an angle from the central axis to two parallel points on each of the two opposite side walls is 30° to 120° degrees.

In an alternative embodiment, the first dielectric component further comprises a plurality of snap hook arms having a plurality of snap hook ends, respectively, whereby the plurality of snap hook ends are engaged and fixed against the inner locking wall of the radially protruding inner end portion of the connector body.

In an alternative embodiment, the connector body further comprises a radial front side surface, formed by the radially protruding outer end portion and the radially protruding inner end portion, having a plurality of attachment protrusions extended thereon. In an embodiment, the shape of the plurality of attachment protrusions is arc-shaped.

In an alternative embodiment, the conductor strip end further comprises an adjustable portion and a fixing portion, whereby the adjustable portion extends from the first conductor body end of the conductor body and when fixed, the fixing portion is perpendicular to the adjustable portion. In an embodiment, a width of the fixing portion of the conductor strip end of the conductor body is smaller than a width of the adjustable portion.

In an alternative embodiment, the conductor body further comprises a plurality of positioning guides surrounding the second conductor body end, each having a free front end and an attached back end, whereby the free front end extends downward and inward toward the central axis of the conductor through-hole.

In an alternative embodiment, the connector further comprises a second dielectric component having a second tube body, a radially supporting outer end portion, a plurality of latches flaring toward the second tube body and a second radial end side surface opposite the plurality of latches, and a second through-hole therethrough having a central axis. The conductor component is engaged and fixed within the second through-hole, whereby the second tube body surrounds the plurality of positioning guides.

In an alternative embodiment, the connector further comprises an inner sleeve having a plurality of radial engaging ends, a central receiving portion, a radial end side surface, and a sleeve through-hole therethrough having a central axis. The second dielectric component is engaged and fixed within the sleeve through-hole; whereby the plurality of radial engaging ends surround the plurality of latches. The inner sleeve is engaged and fixed within the through-hole of the connector body through the second body opening end, whereby a radially indented receiving end of the connector body surround the plurality of radial engaging ends. In an embodiment, the central axis of the connector body, first dielectric component, second dielectric component, and inner sleeve are the same.

These, as well as other components, steps, features, benefits, and advantages of the present application, will now made clear by reference to the following detailed description of the embodiments, the accompanying drawings, and the claims.

BRIEF DESCRIPTION OF THE DRAWINGS

The accompanying drawings, which are incorporated herein and form a part of the Detailed Description of the Invention, illustrate various embodiments of the present invention and, together with the Detailed Description of the Invention, serve to explain principles discussed below. The drawings referred to in this Brief Description of Drawings should not be understood as being drawn to scale unless specifically noted.

DETAILED DESCRIPTION OF THE INVENTION

Figure 1:
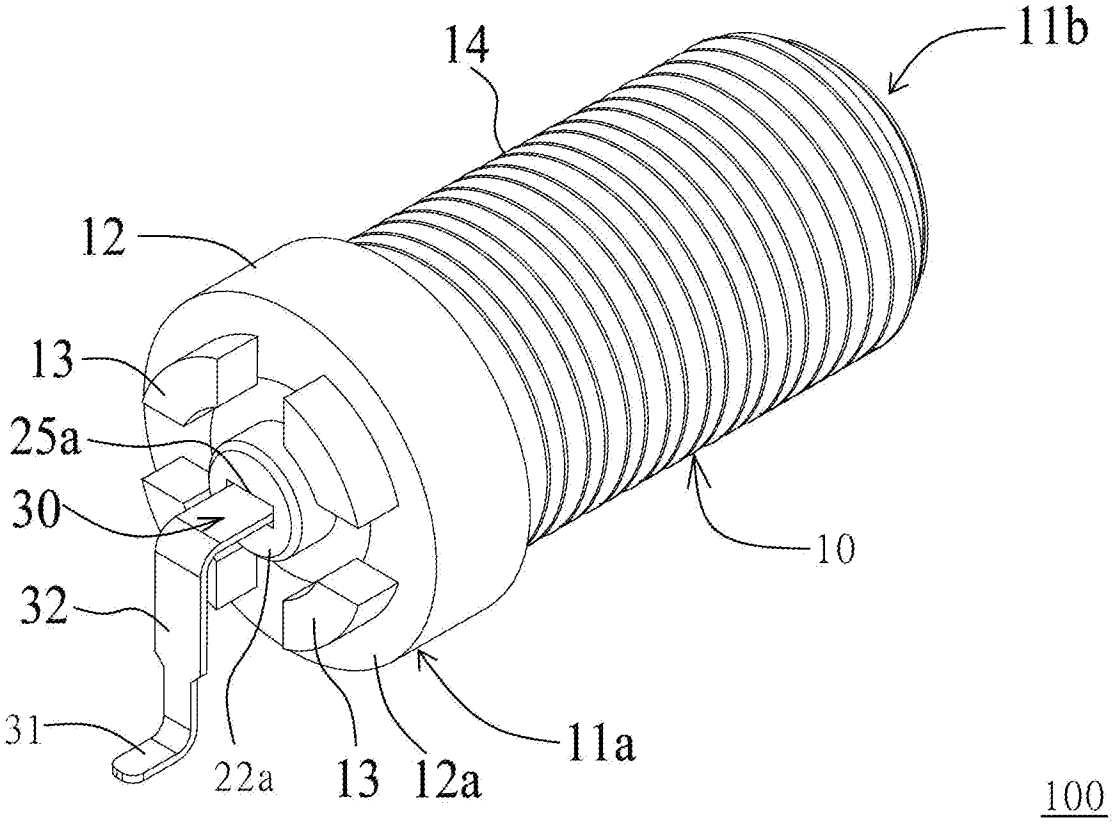
FIG. 1 is a perspective view illustrating a connector according to various embodiments.

It is understood that the following disclosure provides many different embodiments, or examples, for implementing different features of the invention. Specific examples of devices and arrangements are described below to simplify the present disclosure. These are, of course, merely examples and are not intended to be limiting. For example, the formation of a first feature over or on a second feature in the description that follows can include embodiments in which the first and second features are formed in direct contact, and can also include embodiments in which additional features are formed between the first and second features, such that the first and second features are not in direct contact. In addition, the present disclosure can repeat reference numerals and/or letters in the various examples. This repetition is for the purpose of simplicity and clarity and does not in itself dictate a relationship between the various embodiments and/or configurations discussed. It is intended that the scope of the present technology be defined by the claims appended hereto and their equivalents.

A connector comprising a connector body, a first dielectric component, a conductor component, a second dielectric component and an inner sleeve is provided. The connector body has a radial front side surface having a plurality of attachment protrusions extended thereon. The first dielectric component has a protruding end portion comprising a first outlet. The conductor component has a conductor body and a conductor strip end, whereby the conductor strip end extends from the conductor body. The first dielectric component is fixed within the connector body, the second dielectric component is fixed within the inner sleeve, and the inner sleeve is fixed within the connector body. The conductor body is fixed within the second dielectric component, inner sleeve, connector body, and first dielectric component, whereby the conductor strip end extends outwardly from the first outlet, and the conductor strip end is fixedly moveable within the first outlet.

FIG. 1 is a perspective view illustrating a connector according to various embodiments. In the embodiments, as an example, but not to be limiting, a connector 100 can be a twist-type connector for connection to cable TV decoders, digital video recorders and DVD recorders, satellite receivers and distribution amplifiers or signal splitters, etc., having an electromagnetic interference (EMI) shielded enclosure or housing or a mounting means therewith.

Figure 2:
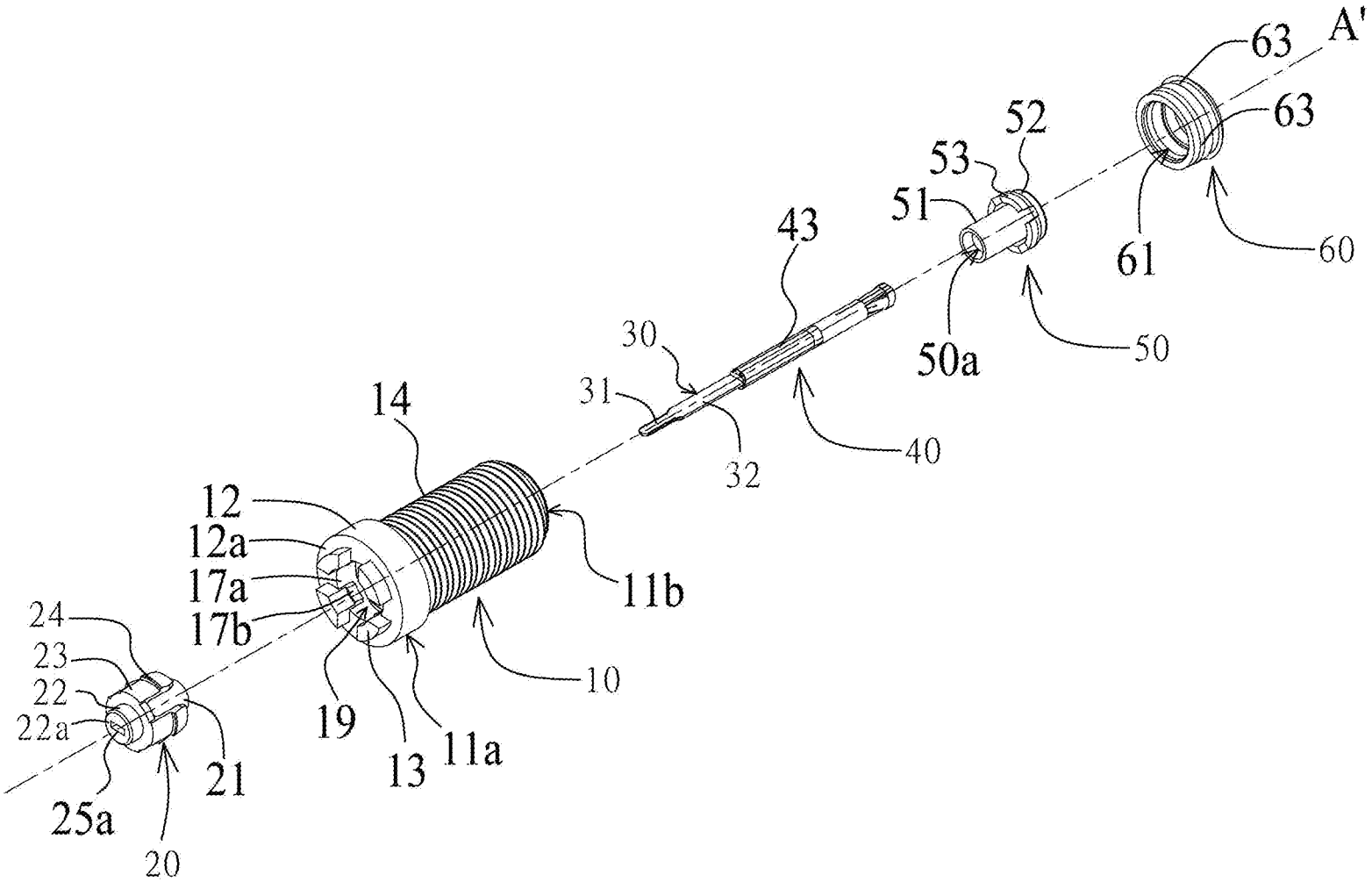
FIG. 2 is an exploded view illustrating a connector according to various embodiments.
Figure 3:
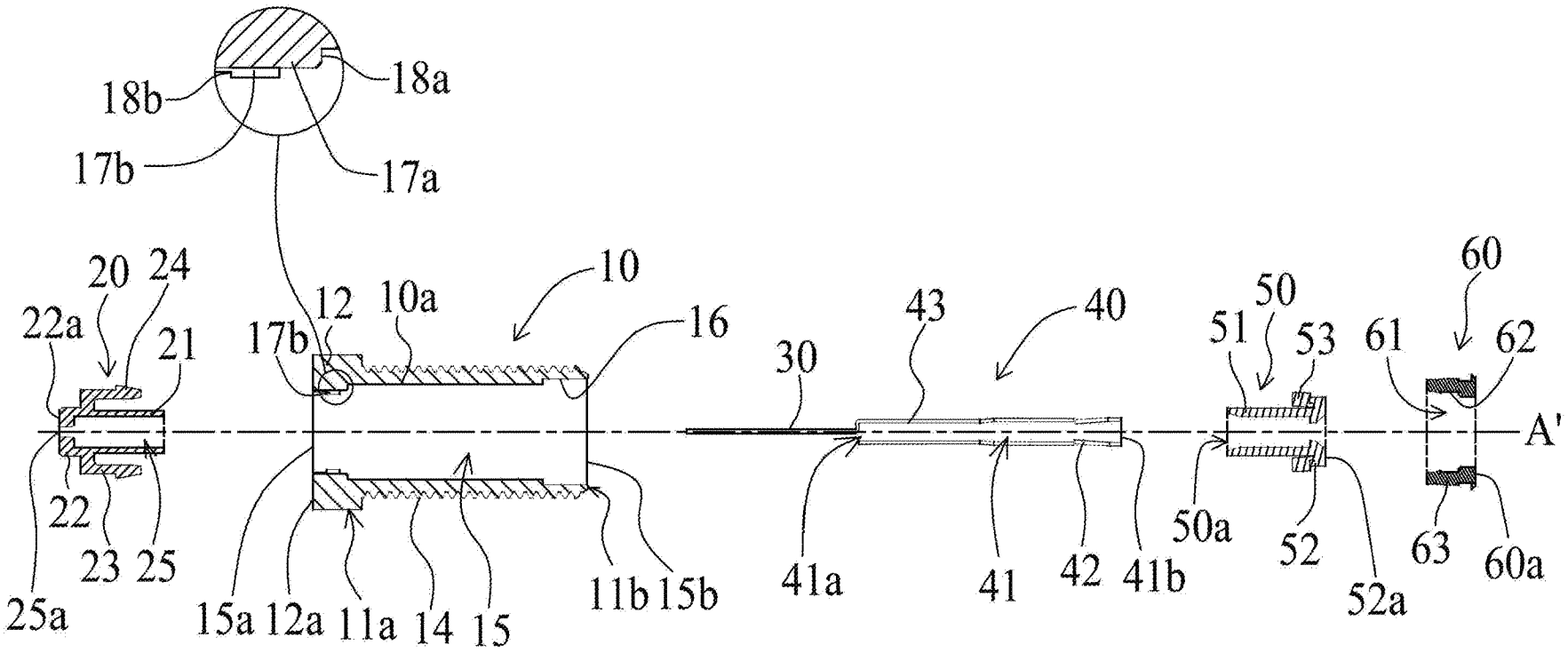
FIG. 3 is an exploded cross-sectional view illustrating a connector according to various embodiments.
Figure 4:
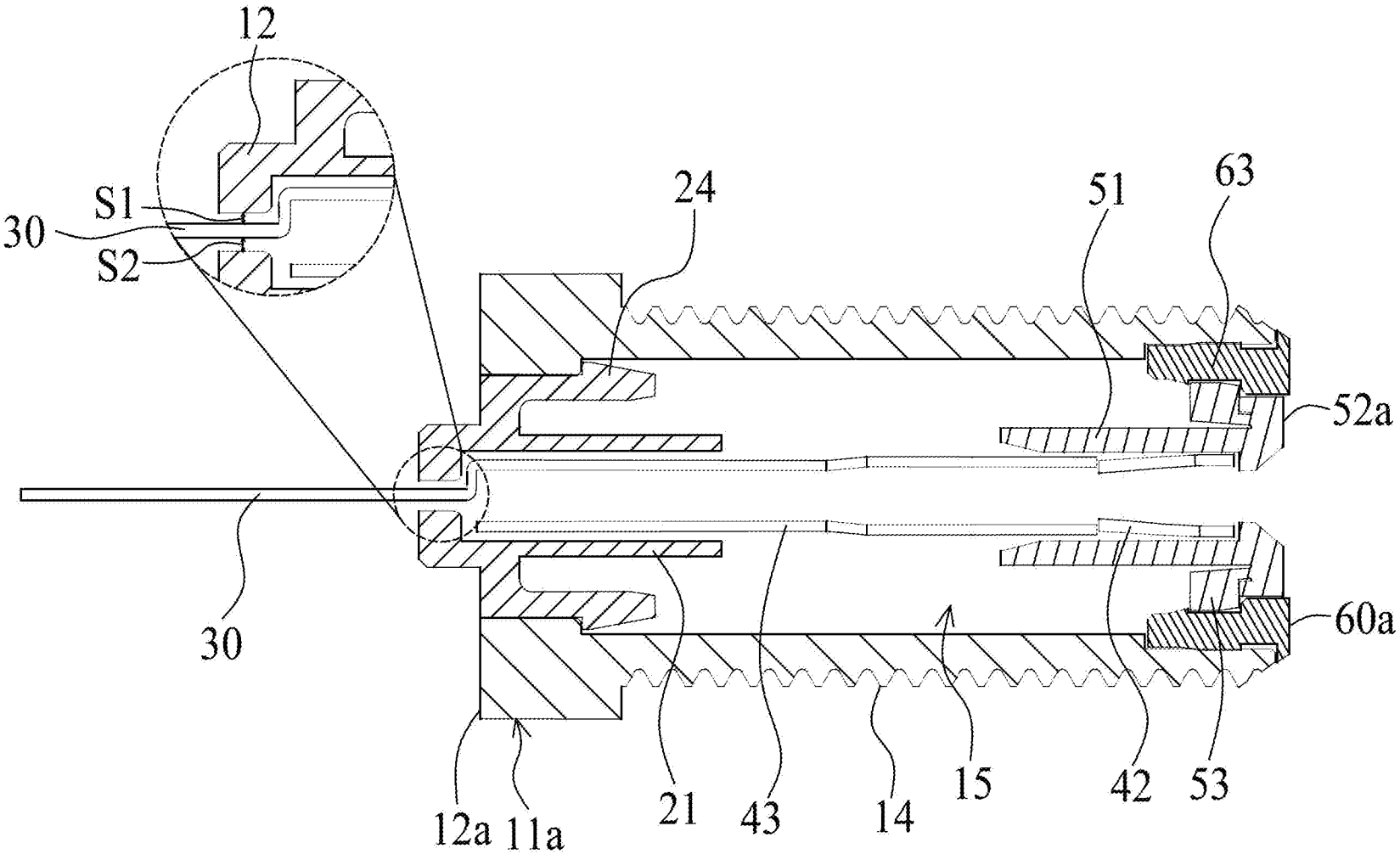
FIG. 4 is a cross-sectional view illustrating a connector according to various embodiments.

FIG. 2 is an exploded view illustrating a connector according to various embodiments. FIG. 3 is an exploded cross-sectional view illustrating a connector according to various embodiments. FIG. 4 is a cross-sectional view illustrating a connector according to various embodiments. As shown in FIGS. 2 to 4, with reference to FIG. 1, in an embodiment, the connector 100 comprises a connector body 10, a first dielectric component 20, and a conductor component 40. In an alternative embodiment, the connector 100 further comprises a second dielectric component 50. In a further alternative embodiment, the connector 100 further comprises an inner sleeve 60.

As an example, and not to be limiting, for assembly of the connector 100, the first dielectric component 20 and connector body 10 can be first snap fit together. Next, the conductor component 40, second dielectric component 50, and the inner sleeve 60 can be assembled thereto thereafter. In the embodiments, the assembly of the connector 100 allows for the conductor component 40 to be engaged and fixed within the connector body 10 and insulated therefrom via the first dielectric component 20 and second dielectric component 50.

In an embodiment, the connector body 10 has a radially protruding outer end portion 12, a threaded outer surface 14 and a through-hole 15 therethrough having a central axis A'. The radially protruding outer end portion 12 radially protrudes outwardly at a first body opening end 15*a* of the connector body 10 and is disposed next to the threaded outer surface 14. In an alternative embodiment, the connector body 10 further comprises a first body end 11*a* and a second body end 11*b* opposite the first body end 11*a*, whereby the first body end 11*a* is the end having the first body opening end 15*a* and the second body end 11*b* is the end having the second body opening end 15*b*. In an embodiment, an inner diameter of the first body opening end 15*a* is less than an inner diameter of the second body opening end 15*b*; however, the embodiments are not limited thereto. In alternative embodiments, the inner diameter of the first body opening end 15*a* can be equal to or greater than the inner diameter of the second body opening end 15*b*.

In an alternative embodiment, the connector body 10 further comprises a radially protruding inner end portion 17*a* having an inner locking wall 18*a* and a plurality of guide protrusions 17*b* thereon having a plurality of blocking guide walls 18*b*, respectively. In an embodiment, the connector body 10 even further comprises a central body wall 10*a* between the radially inner protruding end portion 17*a* and a radially indented receiving end 16. In an embodiment, the radially protruding inner end portion 17*a* radially protrudes inwardly at the first body opening end 15*a* of the connector body 10 and is disposed opposite the radially protruding outer end portion 12. The inner locking wall 18*a* is opposite the first body opening end 15*a* and the plurality of blocking guide walls 18*b* are opposite the second body opening end 15*b*. In an embodiment, the plurality of guide protrusions 17*b* comprises two (2) guide protrusions 17*b*; however, the embodiments are not limited thereto. In alternative embodiments, the plurality of guide protrusions 17*b* comprises more than two (2) guide protrusions 17*b*. In an embodiment, the shape of the radially protruding inner end portion 17*a* is ring-shaped; however, the embodiments are not limited thereto. Any shape or number of shapes known to those skilled in the art can be implemented, so long as the radially protruding inner end portion 17*a* has inner locking wall(s) 18*a* and at least two (2) guide protrusions 17*b* thereon. In an embodiment, the shape of the plurality of guide protrusions 17*b* is arc-shaped; however the embodiments are not limited thereto. In alternative embodiments, other shapes known to those skilled in the art can be implemented for the plurality of guide protrusions 17*b*. In an embodiment, each of the plurality of guide protrusions 17*b* further comprises two opposite side walls perpendicular to the inner locking wall 18*a*, wherein an angle from the central axis A' to two parallel points on each of the two opposite side walls is 30° to 120° degrees.

In an alternative embodiment, the connector body 10 further comprises a radial front side surface 12*a*, formed by the radially protruding outer end portion 12 and the radially protruding inner end portion 17*a*, having a plurality of attachment protrusions 13 extended thereon. In an embodiment, as an example, and not to be limiting, the radial front side surface 12*a* is perpendicular to the through-hole 15 of the connector body 10. In an embodiment, the plurality of attachment protrusions 13 is equidistantly disposed and extended from the radial front side surface 12*a*; however, the embodiments are not limited thereto. In alternative embodiments, the plurality of attachment protrusions 13 can be non-equidistantly disposed and extended from the radial front side surface 12*a*, so long as the connector 100 can be mounted to an electromagnetic interference (EMI) shielded enclosure or housing of corresponding decoders, recorders, receivers, amplifiers or splitters etc. or a mounting means. In an embodiment, the shape of the plurality of attachment protrusions 13 is arc-shaped; however, the embodiments are not limited thereto. The shape of the plurality of attachment protrusions 13 can be any other shape known to those skilled in the art for mounting to an electromagnetic interference (EMI) shielded enclosure or housing of corresponding decoders, recorders, receivers, amplifiers or splitters etc. or a mounting means. In an embodiment, there is a plurality of attachment protrusions 13; however, the embodiments are not limited thereto. One attachment protrusion can be implemented in any shape known to those skilled in the art, for example, and not to be limiting, a ring-shape attachment protrusion can be implemented for mounting to an electromagnetic interference (EMI) shielded enclosure or housing of corresponding decoders, recorders, receivers, amplifiers or splitters etc. or a mounting means. As an example, and not to be limiting, the plurality of attachment protrusions 13 is engaged and mounted to an electromagnetic interference (EMI) shielded enclosure or housing or mounting means, whereby the plurality of attachment protrusions 13 is riveted therethrough, and the radial front side surface 12*a* of the connector body 10 is flush therewith. In the embodiments, the attachment means can be by riveting; however, the embodiments are not limited thereto, the attachment means can be by any means known to those skilled in the art.

As an example, but not to be limiting, in an embodiment, the connector body 10, central body wall 10*a*, radially protruding outer end portion 12, threaded outer surface 14, radially inner protruding end portion 17*a*, plurality of guide protrusions 17*b*, and plurality of attachment protrusions 13 are integrally formed.

In an embodiment, the first dielectric component 20 has a protruding end portion 22, a first tube body 21 and a cylindrical center tube 25 therethrough. In an embodiment, the protruding end portion 22 comprises a first outlet 25*a*, communicative with the cylindrical center tube 25. In an embodiment, the shape of the first outlet 25*a* is square-shaped, rectangular-shaped or flat-shaped. In an embodiment, the first outlet 25*a*, protruding end portion 22, first tube body 21 and cylindrical center tube 25 have a central axis A'.

In an alternative embodiment, the first dielectric component 20 further comprises a plurality of snap hook arms 23 having a plurality of snap hook ends 24, respectively, whereby the plurality of snap hook ends 24 are engaged and fixed against the inner locking wall 18*a* of the radially protruding inner end portion 17*a* of the connector body 10. In an embodiment, an angle from the central axis A' to two parallel points on each of two opposite lateral side walls of each of the plurality of snap hook arms 23 is 15° to 90° degrees. In an embodiment, the plurality of snap hook arms 23 comprises at least two (2) snap hook arms; however, the embodiments are not limited thereto. In alternative embodiments, more than two (2) snap hook arms can be employed. In an embodiment, the plurality of snap hook arms 23 flare backwardly from the protruding end portion 22 of the first dielectric component 20. In an embodiment, a length of the cylindrical center tube 25 is greater than a length of each of the plurality of snap hook arms 23. The plurality of snap hook arms 23, each having a snap hook end 24, slide along a plurality of guide passageways 19 of the radially inner protruding end portion 17*a* and between the plurality of guide protrusions 17*b* of the connector body 10, fittably hooking and locking against the inner locking wall 18*a* of the radially inner protruding end portion 17*a* of the connector body 10.

As an example, but not to be limiting, in an embodiment, the first body tube 21, protruding end portion 22 and plurality of snap hook arms 23 are integrally formed.

In an embodiment, the conductor component 40 has a conductor body 43 comprising a first conductor body end 41*a* and a second conductor body end 41*b* and a conductor through-hole 41 therethrough having a central axis A' and a conductor strip end 30, whereby the conductor strip end 30 extends from the first conductor body end 41*a* of the conductor body 43. As an example, and not to be limiting, the conductor strip end 30 is made of any conductive material known to those skilled in the art and can be a solid component. In an embodiment, the shape of the conductor strip end 30 of the conductor component 40 is square-shaped, rectangular-shaped or flat-shaped. In an embodiment, an inner diameter of the second conductor body end 41*b* is larger than an inner diameter of the first conductor body end 41*a*. In an embodiment, the conductor strip end 30 is fixedly moveable and extends from the first conductor body end 41*a* of the conductor body 43. As an example, and not to be limiting, the first conductor body end 41*a* of the conductor body 43 comprises a first ledge, partially enclosing the first conductor body end 41*a*, whereby the conductor strip end 30 extends from the first ledge. As an example, and not to be limiting, in the embodiments, the conductor body 43 can be made of metal comprising copper, aluminum, silver, nickel, zinc, bismuth, or any combination thereof.

In an alternative embodiment, the conductor body 43 further comprises a plurality of positioning guides 42 surrounding the second conductor body end 41*b*, each having a free front end and an attached back end, whereby the free front end extends downward and inward toward the central axis A' of the conductor through-hole 41. In an embodiment, the plurality of positioning guides 42 comprises at least two (2) positioning guides; however, the embodiments are not limited thereto. In alternative embodiments, more than two (2) positioning guides can be employed.

In an alternative embodiment, the conductor strip end 30 further comprises an adjustable portion 32 and a fixing portion 31, whereby the adjustable portion 32 extends from the first conductor body end 41*a* of the conductor body 43 and when fixed, the fixing portion 31 is perpendicular to the adjustable portion 32. In an embodiment, a width of the fixing portion 31 of the conductor strip end 30 of the conductor body 43 is smaller than a width of the adjustable portion 32.

As an example, but not to be limiting, in an embodiment, the conductor body 43 and conductor strip end 30 are integrally formed.

In an embodiment, the conductor component 40 can be electrically connected to a coaxial cable having an electrical wire, sending electrical signals, whereby, as an example, and not to be limiting, the plurality of attachment protrusions 13 of the connector body 10 is engaged and mounted to an electromagnetic interference (EMI) shielded enclosure or housing or mounting means and the coaxial cable is assembled to the connector body 10. In the embodiments, the assembly means is through screwing of a nut of the coaxial cable (not shown), as an example, and not to be limiting, an F-type connector, to the threaded outer surface 14 of the connector body 10; however, the embodiments are not limited thereto. The assembly means can be any assembly means known to those skilled in the art, as long as the conductor component 40 can be electrically connected to the coaxial cable.

In an embodiment, the first dielectric component 20 is engaged and fixed within the through-hole 15 of the connector body 10 through the first body opening end 15*a*, whereby the protruding end portion 22 protrudes outwardly from the first body opening end 15*a* of the connector body 10. In an embodiment, the conductor component 40 is engaged and fixed within the through-hole 15 of the connector body 10 through a second body opening end 15*b* of the connector body 10 opposite the first body opening end 15*a* and within the cylindrical center tube 25 of the first dielectric component 20, whereby the conductor strip end 30 extends outwardly from the first outlet 25*a* of the dielectric component, and the conductor strip end 30 is fixedly moveable within the first outlet 25*a*. In an embodiment, the central axis A' of the connector body 10 and first dielectric component 20 are the same.

In another alternative embodiment, the first outlet 25*a* of the first dielectric component 20 further comprises a first space S1 and a second space S2, whereby when the conductor strip end 30 of the conductor component 40 is extended and fixed therethrough and the conductor strip end 30 is flat-shaped, the first space S1 exists between a surface of the conductor strip end 30 and wall of the first outlet 25*a* and the second space S2 exists between an opposite surface of the conductor strip end 30 and opposite wall of the first outlet 25*a*, respectively. As an example, and not to be limiting, the distance between either one of the surfaces of the conductor strip end 30 and walls of the first outlet 25*a* can be 1 centimetres (cm) to 3 cm, 1.5 cm to 3.5 cm, or 2 cm to 4 cm. As an example, and not to be limiting, the distance between either one of the surfaces of the conductor strip end 30 and walls of the first outlet 25*a* are not equal.

As an example, and not to be limiting, a nut of a coaxial cable (not shown), as an example, and not to be limiting, an F-type connector can be screwed to the threaded outer surface 14 of the connector body 10, whereby the coaxial cable is electrically connected to the conductor component 40 of the connector 100. As an example, and not to be limiting, a wire of the coaxial cable (not shown) extends through the conductor through-hole 41 of the conductor component 40 via the second body end 41*b*, whereby the free front ends of the plurality of positioning guides 42, respectfully, electrically contact the wire of the coaxial cable, such that electrical signals from the coaxial cable can move freely to and from the conductor strip end 30 of the conductor component 40.

In an alternative embodiment, the connector 100 further comprises a second dielectric component 50 having a second tube body 51, a radially supporting outer end portion 52, a plurality of latches 53 flaring toward the second tube body 51 and a second radial end side surface 52*a* opposite the plurality of latches 53, and a second through-hole 50*a* therethrough having a central axis A'. In an embodiment, the plurality of latches 53 comprises at least two (2) latches; however, the embodiments are not limited thereto. In alternative embodiments, more than two (2) latches can be employed. The conductor component 40 is engaged and fixed within the second through-hole 50*a*, whereby the second tube body 51 surrounds the plurality of positioning guides 42. As an example, but not to be limiting, in an embodiment, the second tube body 51, radially supporting outer end portion 52 and plurality of flexible latches 53 are integrally formed.

In an alternative embodiment, the connector 100 further comprises an inner sleeve 60 having a plurality of radial engaging ends 63, a central receiving portion 62, a radial end side surface 60*a* and a sleeve through-hole 61 therethrough having a central axis A'.

The second dielectric component 50 is engaged and fixed within the sleeve through-hole 61, whereby the plurality of radial engaging ends 63 surround the plurality of latches 53. As an example, and not to be limiting, the second dielectric component 50 and inner sleeve 60 can be snap fit together, for assembly of the connector 100. In an embodiment, a length of the second tube body 51 is greater than a length of each of the plurality of latches 53. In an embodiment, from a viewpoint of the second body opening end 15*b* of the connector body 10, the radial end side surface 60*a* of the inner sleeve 60, second radial end side surface 52*a* of the radially supporting outer end portion 52 of the second dielectric component 50, and conductor through-hole 41 of the conductor component 40 are exposed.

The inner sleeve 60 is engaged and fixed within the through-hole 15 of the connector body 10 through the second body opening end 15*b*, whereby a radially indented receiving end 16 of the connector body 10 surround the plurality of radial engaging ends 63. In an embodiment, the central axis A' of the connector body 10, first dielectric component 20, second dielectric component 50, and inner sleeve 60 are the same.

As an example, and not to be limiting, the first dielectric component 20 and connector body 10 is snap fit together, for assembly of the connector 100. To begin, the first dielectric component 20 is disposed in the through-hole 15 via the first body opening end 15*a*. The plurality of snap hook arms 23, each having a snap hook end 24, slide along the plurality of guide passageways 19 of the radially inner protruding end portion 17*a* and between the plurality of guide protrusions 17*b*, fittably hooking and locking against the inner locking wall 18*a* of the radially inner protruding end portion 17*a*. A plurality of backside spaces of the first dielectric component 20 fittably rest upon each of the plurality of blocking guide walls 18*b* of the connector body 10. Next, the conductor component 40, second dielectric component 50, and inner sleeve 60 is assembled thereto, wherein a nut of a coaxial cable (not shown), as an example, and not to be limiting, an F-type connector is screwed to the threaded outer surface 14 of the connector body 10. The coaxial cable is electrically connected to the conductor component 40 of the connector 100 and the conductor component 40 is electrically connected to the contact pad 204*a* of the panel 204.

Once snap fit assembled, the protruding end portion 22 of the first dielectric component 20 extends from the radial front side surface 12*a* of the connector body 10. Undesired movement of the first dielectric component 20 from the connector body 10 is hindered along the central axis A' by the plurality of blocking guide walls 18*b* of the radially inner protruding end portion 17*a* of the connector body 10 and the plurality of snap hook ends 24 of the first dielectric component 20. Undesired rotational movement along the central axis A' is hindered via the snap fit assembly.

Figure 5A:
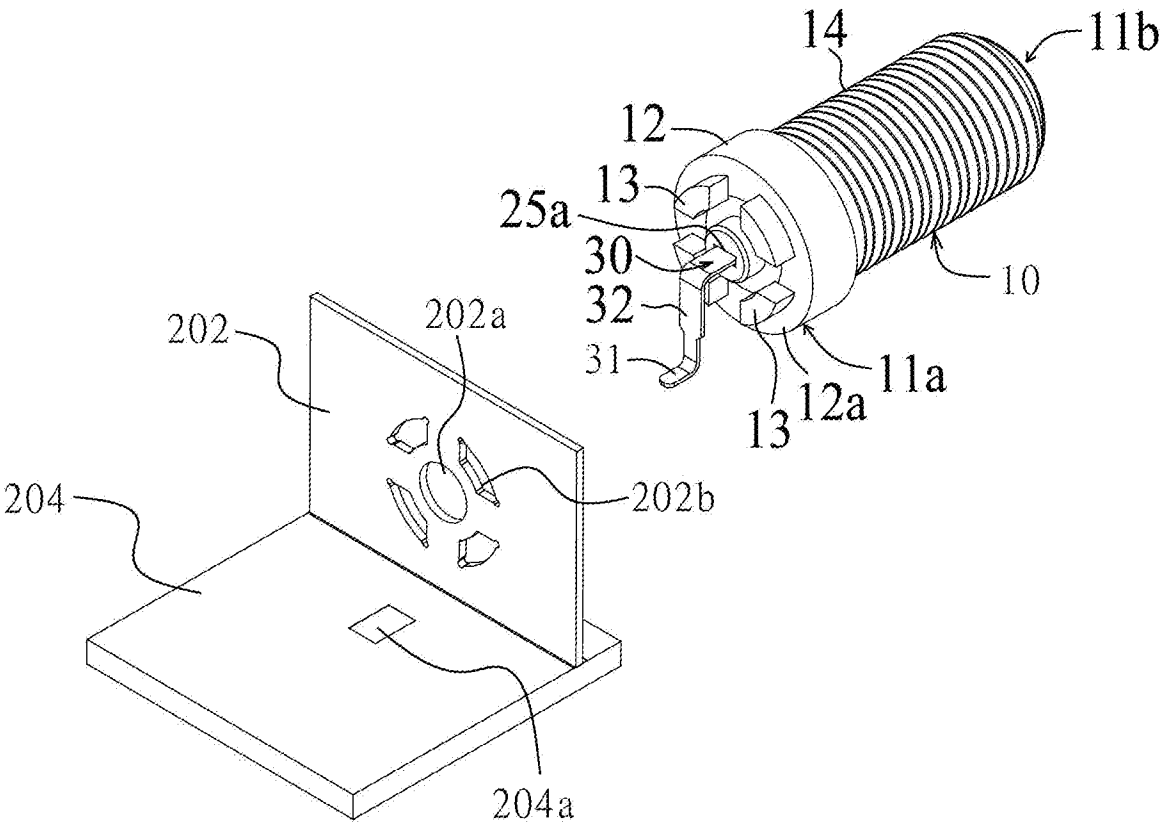
FIG. 5A is a perspective view illustrating a connector according to various embodiments.
Figure 5B:
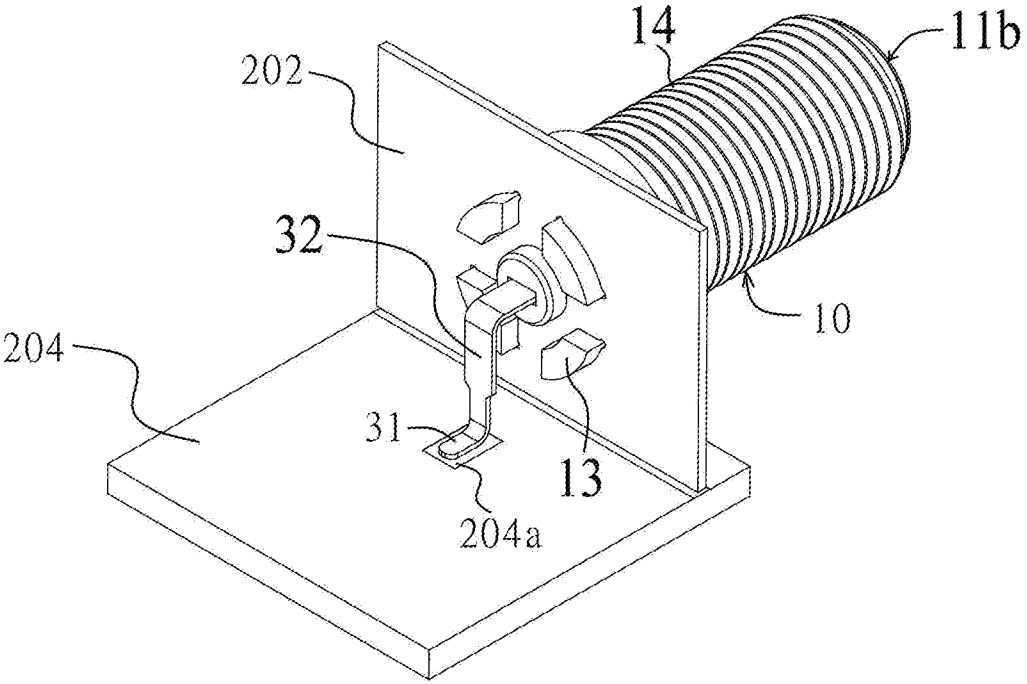
FIG. 5B is a perspective assembled view illustrating the connector of FIG. 5A according to various embodiments.
Figure 5C:
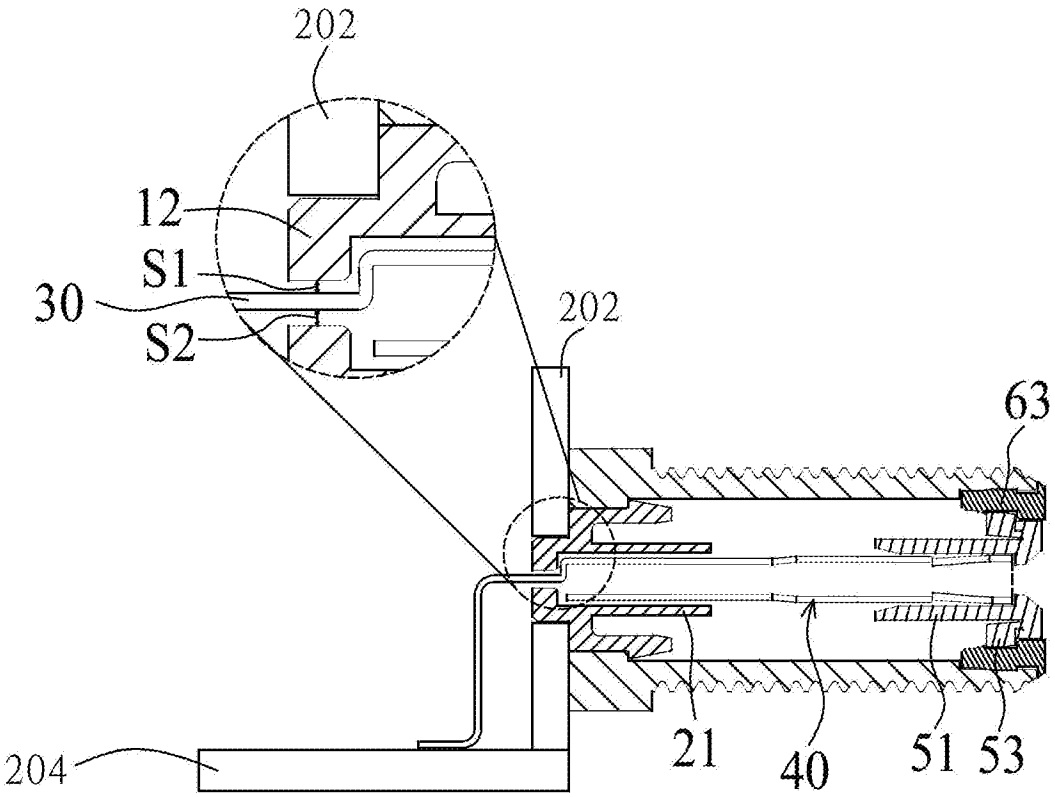
FIG. 5C is a cross-sectional assembled view illustrating the connector of FIG. 5A according to various embodiments.

FIG. 5A is a perspective view illustrating a connector according to various embodiments. FIG. 5B is a perspective assembled view illustrating the connector of FIG. 5A according to various embodiments. FIG. 5C is a cross-sectional assembled view illustrating the connector of FIG. 5A according to various embodiments. As shown in FIGS. 5A to 5C, and referring to FIGS. 1 to 4, as an example, and not to be limiting, a coaxial cable (not shown) can be electrically connected to a conductor component 40 of a connector 100, and engaged and mounted to an electromagnetic interference (EMI) shielded enclosure or housing or mounting means.

In an embodiment, as an example, and not to be limiting, the electromagnetic interference (EMI) shielded enclosure or housing or mounting means (housing) comprises a panel mount 202 having a plurality of attachment through-holes 202*b* and a receiving end through-hole 202*a* therethrough and a panel 204 having a contact pad 204*a* thereon. As an example, and not to be limiting, the panel 204 can be a printed circuit board.

In an embodiment, as an example, and not to be limiting, the plurality of attachment protrusions 13 of the connector body 10 of the connector 100 is engaged and mounted to the housing, whereby the plurality of attachment protrusions 13 is riveted therethrough, and the radial front side surface 12*a* of the connector body 10 is flush therewith. In an embodiment, the protruding end portion 22 of the first dielectric component 20 is engaged and mounted and extended through the receiving end through-hole 202*a* of the panel mount 202 along with the fixing portion 31 and adjustable portion 32 of the conductor strip end 30 of the conductor component 40. As an example, and not to be limiting, the plurality of attachment protrusions 13 are deformed and riveted through the plurality of attachment through-holes 202*b*, respectively, whereby following riveting and mounting, the radial front side surface 12*a* of the connector body 10 is flush with the panel mount 202 and a width of the plurality of attachment protrusions 13 is larger than a width of the plurality of attachment through-holes 202*b*.

As an example and not to be limiting, the mounting means of the coaxial cable is through screwing of a nut of a coaxial cable (not shown), as an example, and not to be limiting, an F-type connector, to the threaded outer surface 14 of the connector body 10, whereby the coaxial cable is electrically connected to the conductor component 40 of the connector 100 and the conductor component 40 is electrically connected to the contact pad 204*a* of the panel 204.

In an embodiment, the fixing portion 31 and adjustable portion 32 of the conductor strip end 30 of the conductor component 40, positioned above the panel 204 having the contact pad 204*a* thereon is next deformed, whereby the fixing portion 31 is perpendicular to the adjustable portion 32 and parallel to the contact pad 204*a*. As an example, and not to be limiting, the flat-shaped conductor component is next electrically connected to the contact pad 204*a* having a large contact area when compared to a wire, as an example, and not to be limiting, via a welding process.

Should the manufacturing or assembly process and/or age of a machine increase, and sufficient accuracy to maintain connector reliability decrease, the conductor body 10 is fixed within the second dielectric component 50, inner sleeve 60, connector body 10, and first dielectric component 20, whereby the conductor strip end 30 extends outwardly from the first outlet 25*a* and is fixedly moveable therein, allowing for simplified adjustments, if required, to ensure reliable contact with the contact pad 204*a*. Greater length tolerances while maintaining sufficient accuracy and quality control is increased and reliability issues related to increased manufacturing or assembly processes and/or age of a machine, and time consuming and inefficient manual labor reliance are decreased.

Coaxial cables continue to be used using connectors such as twistable F-type connectors. Most conventional connectors are manufactured or assembled using semi- or fully-automatic machines, such as cutting, stripping and crimping, riveting and wire welding machines. Despite, as the manufacturing or assembly process and/or age of a machine increase, sufficient accuracy to maintain connector reliability decreases. While required length tolerances and quality control can be implemented with manual labor, human error and maintaining consistent precision can be time consuming and inefficient.

In the embodiments, a connector 100 comprising a connector body 10, a first dielectric component 20, a conductor component 40, a second dielectric component 50 and an inner sleeve is provided. The connector body 10 has a radial front side surface 12*a* having a plurality of attachment protrusions 13 extended thereon. The first dielectric component 20 has a protruding end portion 22 comprising a first outlet 25*a*. The conductor component 40 has a conductor body 43 and a conductor strip end 30, whereby the conductor strip end 30 extends from the conductor body 43. The first dielectric component 20 is fixed within the connector body 10, the second dielectric component 50 is fixed within the inner sleeve, and the inner sleeve is fixed within the connector body 10. The conductor body 10 is fixed within the second dielectric component 50, inner sleeve 60, connector body 10, and first dielectric component 20, whereby the conductor strip end 30 extends outwardly from the first outlet 25*a*, and the conductor strip end 30 is fixedly moveable within the first outlet 25*a*.

The embodiments provide connectors which can be manufactured or assembled having greater length tolerances while maintaining sufficient accuracy and quality control. Reliability issues related to increased manufacturing or assembly processes and/or age of a machine and time consuming and inefficient manual labor reliance is decreased. The embodiments also provide connectors having a flat-shaped conductor component, whereby the connectors can be electrically connected to contact pads having a larger contact area, simplifying, as an example, and not to be limiting, welding processes for electrical connection.

Unless otherwise indicated, all numbers used herein to express quantities, dimensions, and so forth used should be understood as being modified in all instances by the term "about." The use of the singular includes the plural unless specifically stated otherwise, and use of the terms "and" and "or" means "and/or" unless otherwise indicated.

From the foregoing it will be appreciated that, although specific embodiments have been described herein for purposes of illustration, various modifications can be made without deviating from the spirit and scope of the disclosure. Furthermore, where an alternative is disclosed for a particular embodiment, this alternative can also apply to other embodiments even if not specifically stated.

What is claimed is:

1. A connector, comprising:

a connector body having a radially protruding outer end portion, a radially protruding inner end portion, disposed opposite the radially protruding outer end portion, having an inner locking wall and a plurality of guide protrusions thereon having a plurality of blocking guide walls, respectively, a threaded outer surface and a through-hole therethrough having a central axis, wherein the radially protruding outer end portion radially protrudes outwardly at a first body opening end of the connector body and is disposed next to the threaded outer surface, wherein the radially protruding inner end portion radially protrudes inwardly at the first body opening end, and wherein the inner locking wall is opposite the first body opening end and the plurality of blocking guide walls are opposite a second body opening end of the connector body, opposite the first body opening end;

a first dielectric component having, a protruding end portion, a first tube body and a cylindrical center tube therethrough, wherein the protruding end portion comprises a first outlet, and the first outlet, protruding end portion, first tube body and cylindrical center tube have a central axis; and a conductor component having a conductor body comprising a first conductor body end and a second conductor body end and a conductor through-hole therethrough having a central axis and a conductor strip end, whereby the conductor strip end extends from the first conductor body end of the conductor body, wherein the first dielectric component is engaged and fixed within the through-hole of the connector body through the first body opening end, whereby the protruding end portion protrudes outwardly from the first body opening end of the connector body, wherein the conductor component is engaged and fixed within the through-hole of the connector body through the second body opening end and within the cylindrical center tube of the first dielectric component, whereby the conductor strip end extends outwardly from the first outlet of the first dielectric component, and the conductor strip end is fixedly moveable outside of the first outlet, and wherein the central axis of the connector body and first dielectric component are the same.

2. The connector of claim 1, wherein the first dielectric component further comprises a plurality, of snap hook arms having a plurality of snap hook ends, respectively, whereby the plurality of snap hook ends are engaged and fixed against the inner locking wall of the radially protruding inner end portion.

3. The connector of claim 1, wherein the connector body further comprises a radial front side surface, formed by the radially protruding outer end portion and the radially protruding inner end portion, having a plurality of attachment protrusions extended thereon.

4. The connector of claim 3, wherein the shape of the plurality of attachment protrusions is arc-shaped.

5. The connector of claim 1, wherein the shape of the radially protruding inner end portion is ring-shaped.

6. The connector of claim 1, wherein the shape of the plurality of guide protrusions is arc-shaped.

7. The connector of claim 6, wherein the number of the plurality of guide protrusions is at least two.

8. The connector of claim 7, wherein each of the plurality of guide protrusions further comprises two opposite side walls perpendicular to the inner locking wall, and wherein an angle from the central axis to two parallel points on each of the two opposite side walls is 30° to 120° degrees.

9. The connector of claim 1, wherein the shape of the conductor strip end of the conductor component is flat-shaped.

10. The connector of claim 1, wherein the conductor strip end further comprises an adjustable portion and a fixing portion, whereby the adjustable portion extends from the first conductor body end of the conductor body and when fixed, the fixing portion is perpendicular to the adjustable portion.

11. The connector of claim 10, wherein a width of the fixing portion of the conductor strip end of the conductor body is smaller than a width of the adjustable portion.

12. The connector of claim 1, wherein the conductor component can be electrically connected to a coaxial cable having an electrical wire, sending electrical signals.

13. The connector of claim 1, wherein the conductor body further comprises a plurality of positioning guides surrounding the second conductor body end, each having a free front end and an attached back end, whereby the free front end extends downward and inward toward the central axis of the conductor through-hole.

14. The connector of claim 13, further comprising a second dielectric component having a second tube body, a radially supporting outer end portion and a second through-hole therethrough having, a central axis, wherein the conductor component is engaged and fixed within the second through-hole, whereby the second tube body surrounds the plurality of positioning guides, and wherein the central axis of the connector body, first dielectric component, and second dielectric component are the same.

15. The connector of claim 14, wherein the second dielectric component further comprises a radially supporting outer end portion having a plurality of latches flaring toward the second tube body and a second radial end side surface opposite the plurality of latches.

16. The connector of claim 15, further comprising an inner sleeve having a plurality of radial engaging ends, a central receiving portion, a radial end side surface and a sleeve through-hole therethrough having a central axis, wherein the second dielectric component is engaged and fixed within the sleeve through-hole, whereby the plurality of radial engaging ends surround the plurality of latches, and wherein the inner sleeve is engaged and fixed within the through-hole of the connector body through the second body opening end, whereby a radially indented receiving end of the connector body surround the plurality of radial engaging ends, and wherein the central axis of the connector body, first dielectric component, second dielectric component, and inner sleeve are the same.

* * * * *